US005883467A

United States Patent [19]

Chalamala et al.

[11] Patent Number: 5,883,467

[45] Date of Patent: Mar. 16, 1999

[54] FIELD EMISSION DEVICE HAVING MEANS FOR IN SITU FEEDING OF HYDROGEN

[75] Inventors: Babu Chalamala; Arthur J. Ingle, both of Chandler; Charles Rowell, Tempe; Thomas L. Credelle, Phoenix, all of Ariz.

[73] Assignee: Motorola, Inc., Schaumburg, Ill.

[21] Appl. No.: 925,783

[22] Filed: Sep. 9, 1997

[51] Int. Cl.[6] ..... H01J 17/24

[52] U.S. Cl. ..... 313/553; 313/551; 313/495

[58] Field of Search ..... 313/547, 551, 313/553, 481, 561; 445/24, 41; 252/181.6, 181.7

[56] References Cited

U.S. PATENT DOCUMENTS

| | | | |
|---|---|---|---|
| 3,822,086 | 7/1974 | Paik | 316/28 |
| 4,393,506 | 7/1983 | Laakmann et al. | 372/59 |
| 4,663,564 | 5/1987 | Kobale et al. | 313/551 |
| 5,549,934 | 8/1996 | Garza et al. | 427/489 |
| 5,656,889 | 8/1997 | Niiyama et al. | 313/553 |
| 5,684,356 | 11/1997 | Jeng et al. | 313/336 |
| 5,734,226 | 3/1998 | Cathey | 313/553 |

*Primary Examiner*—Sandra O'Shea
*Assistant Examiner*—Matthew J. Gerike
*Attorney, Agent, or Firm*—S. Kevin Pickens

[57] ABSTRACT

A field emission device (100, 200) includes a cathode plate (110, 210), an anode plate (112, 212) spaced from the cathode plate (110, 210) to define an interspace region (114, 214) therebetween, a hole (144, 244) defined by the device package and in communication with the interspace region (114, 214), and a hydrogen-selective membrane (140, 240) disposed in registration with the hole (144, 244).

20 Claims, 3 Drawing Sheets

FIELD EMISSION DEVICE HAVING MEANS FOR IN SITU FEEDING OF HYDROGEN

REFERENCE TO RELATED APPLICATION

Related subject matter is disclosed in a co-pending, commonly assigned patent application entitled "Method for in Situ Cleaning of Electron Emitters in a Field Emission Device", Ser. No. 08/927,367, filed on even date herewith.

FIELD OF THE INVENTION

The present invention pertains to the area of field emission devices and, more particularly, to a field emission device having means for surface decontamination of the electron emitters.

BACKGROUND OF THE INVENTION

A typical field emission device contains electron emitters, such as Spindt tips, which are made from an electron-emissive metal, such as molybdenum. These electron emitters are susceptible to surface contamination by oxygen-containing and carbon-containing species. The surface oxygen and carbon have deleterious effects on the electron emission properties of the electron emitters. In particular, the presence of oxygen and carbon at the emissive surface increases the surface work function of the electron emitters. That is, a bigger electric field is required to extract electrons therefrom due to the contamination. Surface contaminants also result in emission current instability and reduced device lifetime.

Metal field emission tips have been employed in field emission electron and ion microscopy. It is known to remove surface contaminants from electron emitters in these microscopy devices by employing high temperature (greater than 2000° K.) flashing. However, field emission arrays often include glass substrates upon which the electron emitters are formed. These glass substrates have temperature tolerances upwards of 700°–800° K. Thus, high temperature cleaning procedures cannot be used for decontaminating field emission electron emitters formed on glass substrates.

Furthermore, the contamination of field emission electron emitters occurs throughout the life of the field emission device. Contaminant gaseous species are introduced into the vacuum of the field emission device by outgassing from surfaces, by electron-stimulated desorption from the phosphors and other surfaces that are exposed to field emitted electrons, by small leaks in the packaging elements, etc.

In order to maintain constant emission characteristics over the life of the device, it is desirable that emitter surface contaminants be removed throughout the life of the device. It is also desirable that this cleaning process be continuous over the life of the device or be performed periodically at a frequency that is sufficient to prevent appreciable deterioration of emission characteristics. However, field emission devices typically have no convenient means for introducing cleaning agents into the device subsequent to the vacuum sealing of the device package.

Accordingly, there exists a need for a field emission device having means for in situ removal of surface contaminants from field emission electron emitters.

Figure 1:
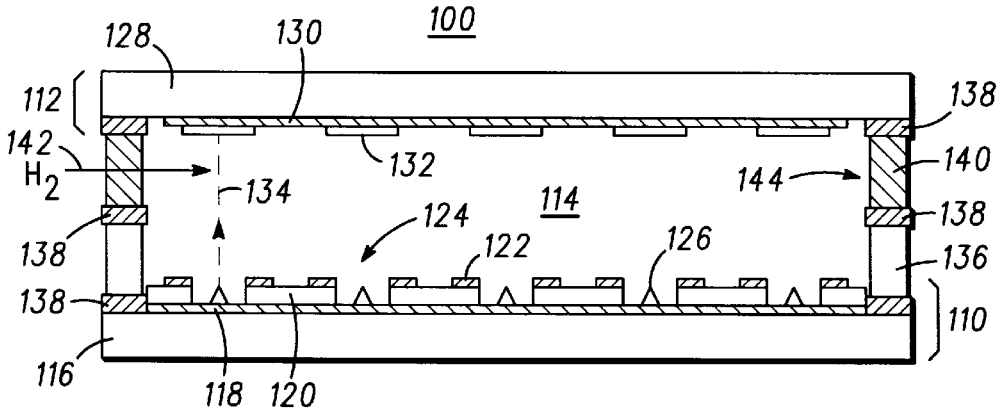
FIG. 1 is a cross-sectional view of a first embodiment of a field emission device configured in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION

The invention is for a field emission device having means for in situ feeding of hydrogen. The hydrogen supplied using said means is utilized to clean the electron emitters of the field emission device. The means for in situ feeding of hydrogen permits cleaning of the electron emitters of the field emission device at any time subsequent to the vacuum sealing of the device package. It is also compatible with the vacuum environment within the device. In one embodiment of the invention, a hydrogen-selective membrane is provided in registration with a hole/gap in the device package. In this embodiment, hydrogen gas is diffused into the device through the hydrogen-selective membrane. In another embodiment of the invention, a hydrogen source is disposed within the device package. The hydrogen source is made from a member having hydrogen entrapped therein. The entrapped hydrogen is controllably released from the hydrogen source by, for example, controlled heating of the hydrogen source. Hydrogen evolution is activated at a rate/frequency sufficient to remove contaminants from the surfaces of the electron emitters, thereby realizing stable electron emission over the life of the device.

The embodiments described herein are directed to field emission display devices having triode configurations and employing Spindt tip electron emitters. However, the scope of the invention is not intended to be limited to display devices, to devices having a triode configuration, nor to devices having Spindt tip electron emitters. In general, the invention can be embodied in a vacuum device that employs field emission electron emitters, such as Spindt tips, edge emitters, wedge emitters, surface conduction emitters, and the like, which are made from a material that can be cleaned using hydrogen free-radicals. Also, the invention can be embodied in a field emission device having a diode configuration or a configuration having greater than three electrodes.

FIG. 1 is a cross-sectional view of a first embodiment of a field emission device (FED) 100 configured in accordance with the invention. FED 100 includes a cathode plate 110, which is spaced from an anode plate 112 to define an interspace region 114 therebetween. Cathode plate 110 includes a plurality of electron emitters 126. In general, during the operation of FED 100, electrons, indicated by a dashed line 134 in FIG. 1, are emitted by electron emitters 126 and are subsequently collected at anode plate 112.

Cathode plate 110 includes a substrate 116, which can be made from glass or some other hard, dielectric material. Upon substrate 116 is disposed a plurality of cathodes 118, which are electrodes made from a conductor, such as molybdenum, aluminum, and the like. A dielectric layer 120 is disposed on cathodes 118 and defines a plurality of emitter wells 124. Electron emitters 126 are disposed one each in emitter wells 124. In the embodiment of FIG. 1, electron emitters 126 include Spindt tips. Electron emitters 126 are made from a field emissive material. Exemplary field emissive materials include molybdenum, niobium, hafnium, tungsten, iridium, silicon, diamond-like carbon, and the like. In general, the field emissive material can be induced to emit electrons by the application of an electric field of appropriate strength. Also, the field emissive material can be conditioned/cleaned using hydrogen free radicals, which include atomic hydrogen and hydrogen ions.

A plurality of gate extraction electrodes 122 is configured upon dielectric layer 120 for selectively addressing electron emitters 126. Gate extraction electrodes 122 are made from a conductive material, such as molybdenum, aluminum, and the like. Methods for fabricating cathode plate 110 are known to one skilled in the art.

Anode plate 112 includes a transparent substrate 128 made from a solid, transparent material, such as a glass. An anode 130 is formed on transparent substrate 128. Anode 130 is made from a transparent, conductive material, such as indium tin oxide. Anode plate 112 further includes a plurality of phosphors 132, which are made from a cathodoluminescent material.

Between cathode plate 110 and anode plate 112, at their peripheries, is disposed a frame 136, which provides standoff therebetween. Frame 136 can be made from a glass and is affixed to cathode plate 110 with a sealant 138. Sealant 138 can be a frit sealant, indium metal, a low temperature metal sealant, and the like. Cathode plate 110, anode plate 112, and frame 136 define a device package.

In accordance with the invention, a hydrogen-selective membrane is disposed in registration with a hole defined by the device package. In the embodiment of FIG. 1, a hydrogen-selective membrane 140 is disposed within a hole 144 defined by frame 136 and anode plate 112. Hydrogen-selective membrane 140 is made from a refractory metal, such as palladium, nickel, a palladium alloy, a nickel alloy, and the like, which is selectively permeable with respect to hydrogen. Preferably, hydrogen-selective membrane 140 is made from palladium. Hydrogen-selective membrane 140 has a thickness, in the direction of hydrogen diffusion, within a range of 50–500 micrometers. Under the appropriate conditions of temperature and pressure, hydrogen gas is capable of selectively diffusing through hydrogen-selective membrane 140.

The embodiment of FIG. 1 can be fabricated by first silk-screening sealant 138 onto transparent substrate 128 at the periphery thereof. Then, hydrogen-selective membrane 140 is disposed on sealant 138. Refractory metal membranes, having thicknesses greater than about 10 micrometers, are available commercially. Such a refractory metal membrane can be cut into a suitable shape to form hydrogen-selective membrane 140. The structure is then heated to affix the refractory metal to sealant 138.

Anode plate 112, having hydrogen-selective membrane 140 formed thereon, is assembled with cathode plate 110, having frame 136 affixed thereto, in a vacuum environment, so that a vacuum is realized within interspace region 114. As illustrated in FIG. 1, hydrogen-selective membrane 140 is thus disposed in communication with interspace region 114. That is, hydrogen gas, which is indicated by an arrow 142 in FIG. 1, that diffuses through hydrogen-selective membrane 140 can subsequently travel into interspace region 114.

Subsequent to the steps of sealing the elements of FED 100 and establishing a vacuum environment therein, the following steps can be used to achieve in situ feeding of hydrogen gas to interspace region 114. First, FED 100 is placed in an oven having a hydrogen atmosphere. The hydrogen atmosphere within the oven has a hydrogen partial pressure within a range of milli-Torr to several atmospheres. Then, the temperature within the oven is elevated to within a range of about 273°–450° K. In general, the temperature and partial pressure of hydrogen within the hydrogen atmosphere are selected to promote diffusion of hydrogen gas through hydrogen-selective membrane 140.

The diffusion of hydrogen into interspace region 114 is performed for a period of time sufficient to provide within interspace region 114 a partial pressure of hydrogen useful for cleaning electron emitters 126. The partial pressure of hydrogen within FED 100 is preferably within a range of $10^{-8}$–$10^{-5}$ Torr.

The hydrogen content can be determined by measuring the total pressure within FED 100 prior to the addition of hydrogen and thereafter measuring the total pressure within FED 100 after the addition of hydrogen. If these two measurements are taken at the same temperature, the final hydrogen partial pressure can be derived therefrom by, for example, using the ideal gas law.

In general, clean electron emitters 126 ameliorate the fluctuations in the emission current for a given set of conditions, including voltages and temperature. Thus, the level of contamination of electron emitters 126 can be deduced from measured fluctuations in the emission current. A partial pressure of hydrogen is established that provides stabilized emission current having fluctuations within a tolerable range. For example, it may be desirable to maintain current fluctuations of less than 0.5% per hour for a given set of conditions.

Subsequent to the addition of hydrogen gas to interspace region 114, electron emitters 126 are cleaned. This is achieved by first activating electron emitters 126 to emit electrons. Electron emission is realized by applying the appropriate potentials to cathodes 118 and gate extraction electrodes 122, as is known to one skilled in the art. The emitted electrons are then attracted toward anode 130 by applying thereto an appropriate potential. As they travel across interspace region 114, the emitted electrons dissociate and ionize the hydrogen molecules present therein, thereby forming hydrogen free radicals within interspace region 114.

The hydrogen free-radicals, which include hydrogen ions and energetic neutral hydrogen atoms, react with the surfaces of electron emitters 126, which include surface contaminants, to form volatile hydrides. Exemplary volatile hydrides that may be produced include: $H_2O$, $MoH_x^+$ (x=1–3), $MoOH^+$, $OH^+$, OH, $H^+$, $CH_x^+$ (x=1–4), and the like. These volatile hydrides are then removed from interspace region 114 by gettering material (not shown) present within FED 100.

This procedure for cleaning and conditioning electron emitters 126 can be performed shortly after sealing of the device package to remove surface contaminants, native oxides, and process residues. The cleaning procedure can also be performed after a period of use of FED 100, thereby reconditioning electron emitters 126 and removing surface contaminants accumulated during the operation of FED 100.

In this manner, stable electron emission is realized over the life of FED 100.

In general, and in accordance with the invention, the means for in situ feeding of hydrogen is disposed in communication with the interspace region of the device package. In the embodiment having a hydrogen-selective membrane, the hydrogen-selective membrane is configured in registration with a hole/gap defined by the device package. Under appropriate conditions of pressure and temperature, this configuration allows hydrogen gas to diffuse from a hydrogen atmosphere external to the field emission device, through the hydrogen-selective membrane, and into the interior of the field emission device.

Figure 2:
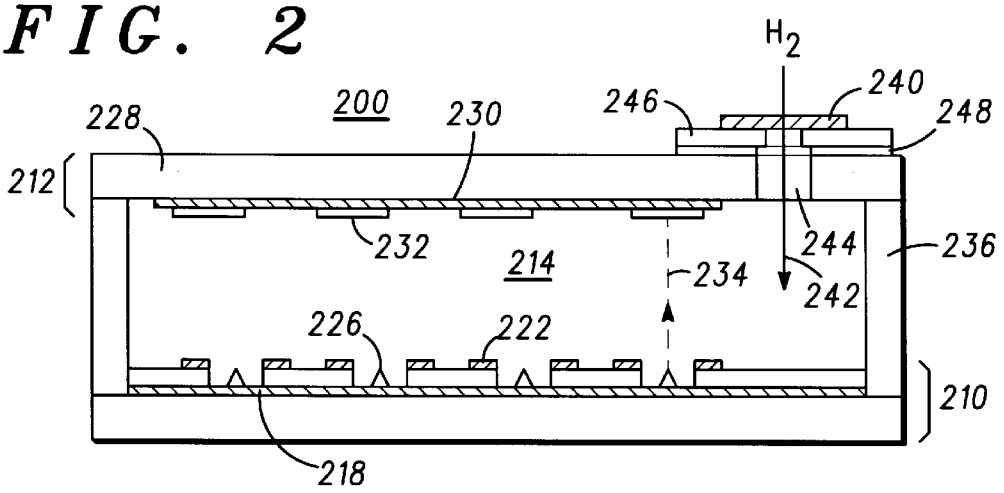
FIG. 2 is a cross-sectional view of a second embodiment of a field emission device configured in accordance with the invention.

FIG. 2 is a cross-sectional view of a second embodiment of a field emission device (FED) 200 configured in accordance with the invention. In the embodiment of FIG. 2, a hole 244 is defined by a transparent substrate 228 of an anode plate 212. Transparent substrate 228 is made from a hard, transparent material, such as a glass, and has affixed thereto an anode 230 and a plurality of phosphors 232. FED 200 further includes a hydrogen-selective membrane 240, which overlies hole 244. Hydrogen-selective membrane 240 includes a membrane made from a refractory metal such as palladium, nickel, and the like, which is selectively permeable to hydrogen. The thickness of hydrogen-selective membrane is preferably within a range of 50–500 micrometers.

FED 200 is fabricated by first making a cathode plate 210, in a manner similar to that described with reference to FIG. 1. Cathode plate 210 includes a plurality of cathodes 218, a plurality of electron emitters 226, and a plurality of gate extraction electrodes 222. A frame 236 is attached to the periphery of cathode plate 210 by using a frit sealant (not shown). Anode plate 212 is attached to frame 236 to define an interspace region 214. The step of attaching anode plate 212 can be performed in air because, subsequent to the sealing process, interspace region 214 can be evacuated through hole 244 using a vacuum pump, as is known to one skilled in the art.

Hydrogen-selective membrane 240 is affixed to anode plate 212 by first providing a ring 246 made from an alloy having thermal expansion characteristics that match those of transparent substrate 228. Hydrogen-selective membrane 240 is brazed to ring 246, so that it covers the hole defined by ring 246. Then the hole defined by ring 246 is positioned in registration with hole 244 of transparent substrate 228. Ring 246 is attached to transparent substrate 228 using a frit sealant 248. The step of attaching ring 246, having hydrogen-selective membrane 240 affixed thereto, to transparent substrate 228 is performed subsequent to the evacuation of the device package.

Subsequent to the step of attaching hydrogen-selective membrane 240 to the device package, a hydrogen partial pressure is established within FED 200, in a manner similar to that described with reference to FIG. 1. Under appropriate conditions of temperature and pressure, hydrogen gas, which is indicated by an arrow 242 in FIG. 2, is diffused through hydrogen-selective membrane 240 and travels into interspace region 214. Within interspace region 214, the hydrogen gas is converted into hydrogen free-radicals by electrons, which are indicated by a dashed line 234 in FIG. 2, that are emitted by electron emitters 226.

Figure 3:
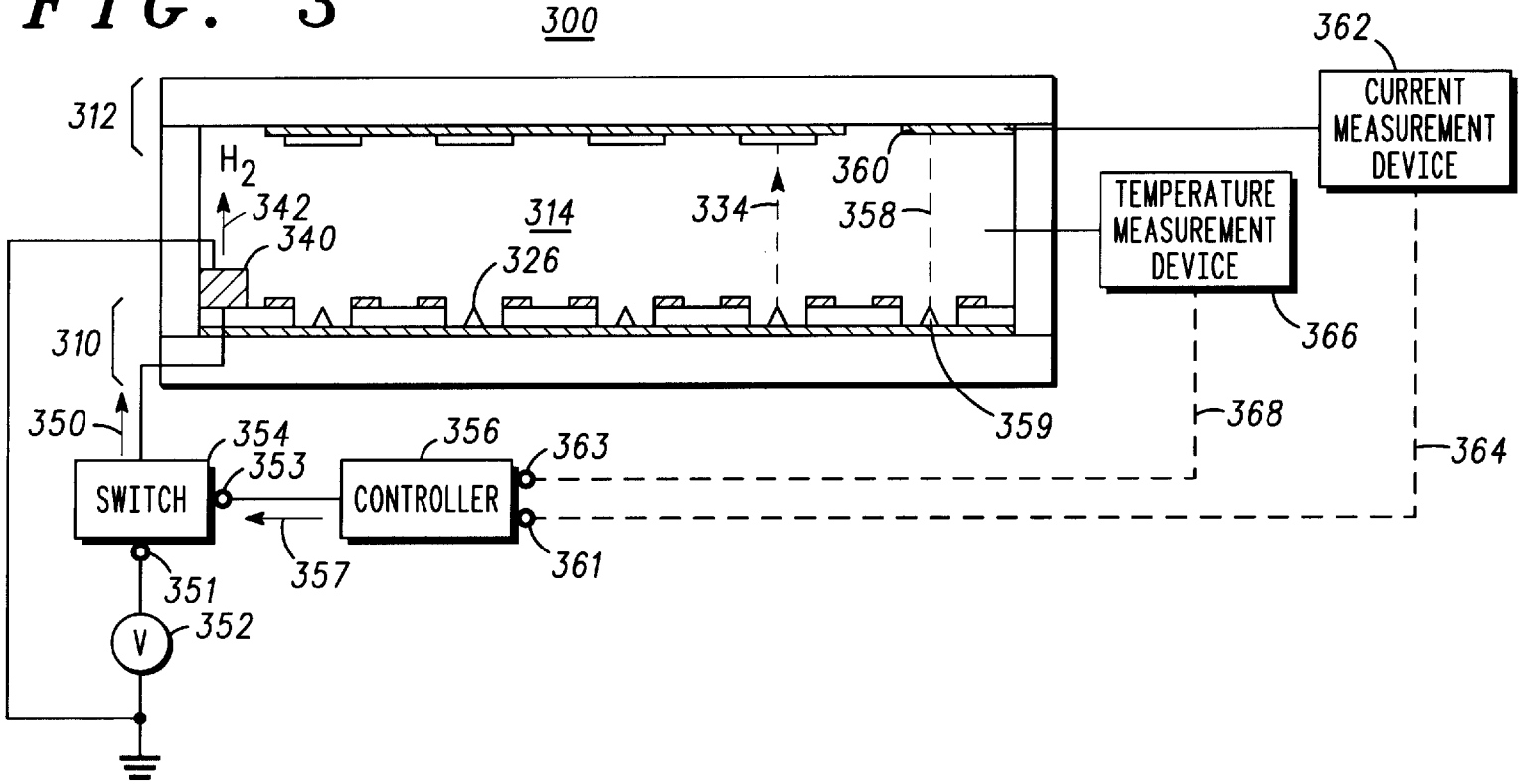
FIG. 3 is a cross-sectional view of a third embodiment of a field emission device configured in accordance with the invention and includes a block diagram of means for controlling the rate of hydrogen evolution from a hydrogen source.

FIG. 3 is a cross-sectional view of a third embodiment of a field emission device (FED) 300 configured in accordance with the invention and includes a block diagram of means for controlling the rate of hydrogen evolution from a hydrogen source 340. FED 300 has a cathode plate 310 and an anode plate 312, which define an interspace region 314. FED 300 further includes hydrogen source 340, which is disposed within interspace region 314. Hydrogen source 340 includes a solid member made from a refractory metal, such as palladium, nickel, a palladium alloy, a nickel alloy, and the like. Preferably, hydrogen source 340 is made from palladium. Hydrogen source 340 is secured to one of the surfaces defining interspace region 314 by a convenient method, such as by using a frit sealant or mechanical means.

Hydrogen source 340 contains hydrogen. The hydrogen is provided within by hydrogen source 340 by placing the metallic member in an oven having a hydrogen atmosphere. The temperature in the oven is elevated to induce the diffusion of hydrogen gas into the metallic member. After a sufficient amount of hydrogen has been diffused into the metallic member, the metallic member is cooled, thereby entrapping the hydrogen contained therein.

A plurality of electron emitters 326 within FED 300 are cleaned and conditioned by controllably releasing hydrogen gas, which is indicated by an arrow 342 in FIG. 3, from hydrogen source 340. The rate/frequency of hydrogen evolution from hydrogen source 340 is controlled so as to provide within interspace region 314 a partial pressure of hydrogen that is useful for maintaining a stable emission current. A dashed line 334 in FIG. 3 indicates the emission current.

In the embodiment of FIG. 3, hydrogen gas is released from hydrogen source 340 by heating hydrogen source 340. Hydrogen source 340 can be heated by passing a current directly through hydrogen source 340. Alternatively, hydrogen source 340 can be heated by providing a heating element, such as a resistive wire, and providing thermal contact between hydrogen source 340 and the heating element. Another method for heating hydrogen source 340 is by using an infrared laser.

Illustrated in FIG. 3 is a block diagram of a control system useful for controlling the rate of hydrogen evolution from hydrogen source 340. The control system includes a switching circuit 354, a controller 356, a temperature measurement device 366, and a current measurement device 362.

Controller 356 controls a test emission current 358 that is emitted by a test electron emitter 359. The characteristics of test emission current 358 are representative of the characteristics of the emission currents from the remainder of electron emitters 326. Controller 356 controls test emission current 358 by manipulating the rate of hydrogen evolution from hydrogen source 340 in response to a first signal 364 from current measurement device 362 and a second signal 368 from temperature measurement device 366.

A current measurement electrode 360 is configured on anode plate 312 to receive test emission current 358. Current measurement device 362 is connected to current measurement electrode 360 for measuring test emission current 358. Current measurement device 362 transmits first signal 364, which is related to test emission current 358, to a first input terminal 361 of controller 356.

Temperature measurement device 366 measures a temperature within interspace region 314 and transmits second signal 368, which is related to the temperature, to a second input terminal 363 of controller 356. The value of the emission current is dependent, in part, upon temperature. Controller 356 corrects for this temperature dependence when determining the status of the emission current. When the corrected value of the emission current drops below a predetermined level, the controller transmits a control signal 357 to a first input terminal 353 of switching circuit 354.

Switching circuit 354 is responsive to control signal 357. Switching circuit 354 has an output that is connected to hydrogen source 340 for transmitting an activation current 350 thereto. In general, switching circuit 354 transmits activation current 350 to hydrogen source 340 when the corrected emission current drops below a predetermined value due to surface contamination of electron emitters 326. In the embodiment of FIG. 3, a voltage source 352 is connected to a second input terminal 351 of switching circuit 354. Voltage source 352 can be included in the power supply of FED 300.

Due to the heating of hydrogen source 340, the temperature within FED 300 may increase. It is desired to maintain the temperature within FED 300 below that which results in an excessive, catastrophic emission current at electron emitters 326. Controller 356 is designed to cease heating hydrogen source 340 when the temperature measured by temperature measurement device 366 reaches an upper limit. In this manner, the emission current is prevented from attaining a catastrophic level due to overheating within FED 300 caused by the heating of hydrogen source 340.

Figure 4:
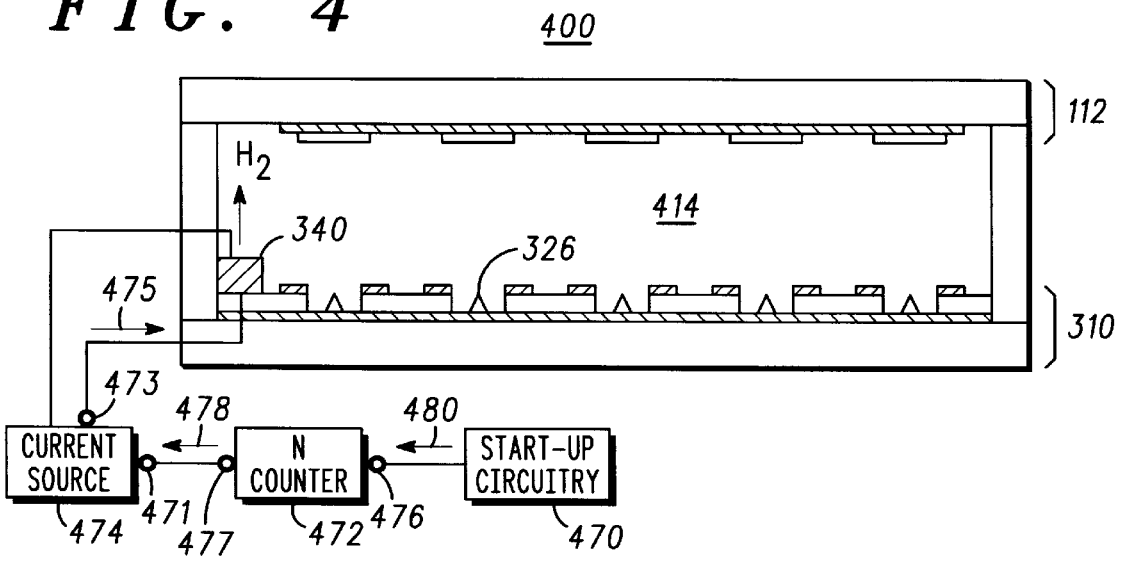
FIG. 4 is a cross-sectional view of a fourth embodiment of a field emission device configured in accordance with the invention and includes a block diagram of means for controlling the rate of hydrogen evolution from a hydrogen source.

FIG. 4 is a cross-sectional view of a fourth embodiment of a field emission device (FED) 400 configured in accordance with the invention and includes a block diagram of means for controlling the rate of hydrogen evolution from hydrogen source 340. FED 400 includes anode plate 112 and cathode plate 310, which define an interspace region 414. In the embodiment of FIG. 4, the system for controlling the rate of hydrogen evolution from hydrogen source 340 includes a current source 474 and an N-counter circuit 472.

FED 400 has a start-up circuit 470, which initially activates the device. Start-up circuit 470 is coupled to cathode plate 310 and anode plate 112 (connections not shown) and provides the proper operating voltage for powering FED 400. When start-up circuit 470 is activated, it transmits a start-up signal 480 to an input terminal 476 of N-counter circuit 472. Start-up signal 480 triggers a counter. When the counter reaches N, N-counter circuit 472 transmits from an output terminal 477 an activation signal 478. Activation signal 478 is received at an input terminal 471 of current source 474.

Current source 474 has an output terminal 473 that is connected to hydrogen source 340. Upon receipt of activation signal 478, current source 474 transmits an activation current 475 to hydrogen source 340, resulting in evolution of hydrogen gas from hydrogen source 340.

The amount of current sent to hydrogen source 340 each time N-counter reaches N and the value of N depend upon factors such as the size of FED 400 and the anticipated extent of contamination during a given period of use of FED 400. The latter factor depends in part upon the nature of the materials present within FED 400. For example, different materials may generate contaminants at different rates.

Another embodiment of a field emission device in accordance with the invention has a system for controlling the evolution of hydrogen, which includes a timer circuit. The configuration of this embodiment is similar to that of FIG. 4 in that a current source is connected to the hydrogen source. However, instead of an N-counter circuit, a timer circuit is used to generate a periodic activation signal, which is sent to the current source. In this manner, a predetermined amount of current can be periodically transmitted to the hydrogen source at predetermined intervals. For example, hydrogen evolution can be provided once per month using this configuration.

Figure 5:
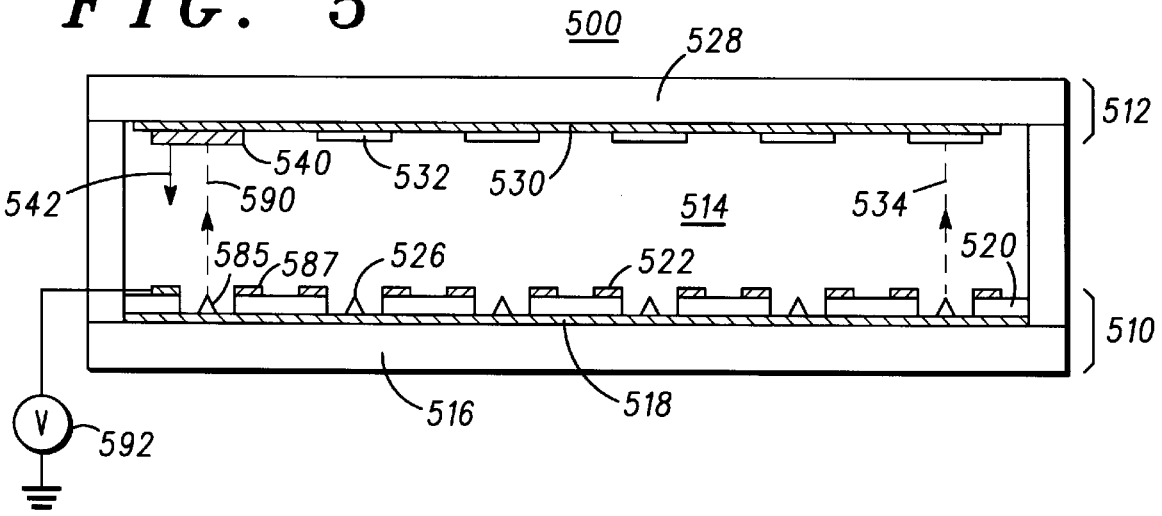
FIG. 5 is a cross-sectional view of a fifth embodiment of a field emission device configured in accordance with the invention.

FIG. 5 is a cross-sectional view of a fifth embodiment of a field emission device (FED) 500 configured in accordance with the invention. Hydrogen evolution into an interspace region 514 of FED 500 is realized by an electron-stimulated hydrogen desorption process.

FED 500 includes a hydrogen source 540, which opposes an activation electron emitter 585. Hydrogen source 540 is made in the manner described with reference to hydrogen source 340 of FIGS. 3 and 4. A cathode plate 510 includes activation electron emitter 585, which is one of a plurality of electron emitters 526 disposed within emitter wells defined by a dielectric layer 520. Electron emitters 526 are connected to a plurality of cathodes 518, which are disposed on a substrate 516.

Hydrogen, which is indicated by an arrow 542 in FIG. 5, is evolved from hydrogen source 540 by impacting electrons onto hydrogen source 540. In the embodiment of FIG. 5, these electrons, which are generally indicated by a dashed line 590, are provided by selectively addressing activation electron emitter 585. An activation gate extraction electrode 587 is disposed proximate to activation electron emitter 585 and is coupled to a voltage source 592. Activation gate extraction electrode 587 is controlled independently from a plurality of gate extraction electrodes 522, which are used to selectively address those of electron emitters 526 that oppose a plurality of phosphors 532.

Voltage source 592 is used to selectively apply an extraction voltage at activation gate extraction electrode 587. When hydrogen evolution from hydrogen source 540 is desired, voltage source 592 is used to apply the extraction voltage to activation gate extraction electrode 587, thereby realizing electron emission from activation electron emitter 585. When no hydrogen evolution from hydrogen source 540 is desired, voltage source 592 is used to apply a voltage that does not result in electron emission from activation electron emitter 585. The output voltage of voltage source 592 can be manipulated using one of a number of useful control methods, such as those described with reference to FIGS. 3 and 4.

An electron-attracting voltage is provided at hydrogen source 540, so that the electrons from activation electron emitter 585 are attracted to and collected at hydrogen source 540. In the embodiment of FIG. 5, hydrogen source 540 is disposed on an anode plate 512. Anode plate 512 includes a transparent substrate 528, upon which is formed an anode 530. Hydrogen source 540 is connected to anode 530, to which the electron-attracting voltage is applied. Phosphors 532 are also configured on anode 530. The electrons collected at hydrogen source 540 stimulate hydrogen evolution therefrom. The hydrogen thus evolved is then ionized by electrons within interspace region 514, including the electrons, which are generally indicated by a dashed line 534, directed toward phosphors 532.

In an alternative embodiment, the hydrogen source is not coupled to the anode that biases the phosphors. Rather, the hydrogen source is coupled to an independent voltage source, so that the voltage at the hydrogen source can be manipulated independently from the voltage at the phosphors. In this particular embodiment, the electrons for use for hydrogen evolution can be provided by any of the electron emitters within the device. The emitted electrons are directed toward the hydrogen source by selectively biasing it to attract the electrons. For example, subsequent to the sealing and evacuation of the device, some or all of the electron emitters are caused to emit electrons. Simultaneously, a positive, attracting voltage is selectively applied to the hydrogen source. After the decontamination steps are completed, the positive, attracting voltage is removed from the hydrogen source. Any subsequently emitted electrons can be directed toward the phosphors by selectively applying a positive, attracting voltage to the phosphors.

In summary, the invention is for a field emission device having means for in situ feeding of hydrogen. The hydrogen supplied using said means is utilized to clean the electron emitters of the field emission device. The means for in situ feeding of hydrogen permits cleaning of the electron emitters at any time subsequent to the vacuum sealing of the device package. It is also compatible with the vacuum environment within the device. In the field emission device of the invention, hydrogen gas can be controllably introduced at a rate/frequency sufficient to remove surface contaminants and maintain clean electron emitters, thereby realizing stable electron emission over the life of the device.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

We claim:

1. A field emission device comprising:

a cathode plate;

an anode plate spaced from the cathode plate to define an interspace region therebetween; and a hydrogen source disposed within the interspace region wherein the hydrogen source comprises a member made from a refractory metal.

2. The field emission device as claimed in claim 1, wherein the hydrogen source comprises a member made from palladium.

3. The field emission device as claimed in claim 1, wherein the hydrogen source comprises a member made from nickel.

4. The field emission device as claimed in claim 1, wherein the hydrogen source comprises a member made from a palladium alloy.

5. The field emission device as claimed in claim 1, wherein the hydrogen source comprises a member made from a nickel alloy.

6. A field emission device comprising:

a cathode plate;

an anode plate spaced from the cathode plate to define an interspace region therebetween; and a hydrogen source disposed within the interspace region, wherein the hydrogen source is disposed to receive field-emitted electrons.

7. The field emission device as claimed in claim 6, wherein the cathode plate further includes an activation electron emitter, and wherein the hydrogen source opposes the activation electron emitter.

8. A field emission device comprising:

a cathode plate, an anode plate spaced from the cathode plate to define an interspace region therebetween;

a hydrogen source disposed within the interspace region; and control means operably coupled to said hydrogen source for controlling the rate of hydrogen evolution from the hydrogen source.

9. The field emission device as claimed in claim 8, wherein said control means comprises:

a switching circuit having an input terminal and an output terminal, the output terminal of the switching circuit connected to the hydrogen source for transmitting an activation current thereto;

a controller having first and second input terminals and an output terminal, the output terminal of the controller connected to the input terminal of the switching circuit for sending a control signal thereto;

a current measurement device operably coupled to a test electron emitter for measuring a test emission current emitted therefrom and having an output terminal connected to the first input terminal of the controller for transmitting a first signal thereto, the first signal being related to the test emission current; and a temperature measurement device operably coupled to the interspace region for measuring a temperature therein and having an output terminal connected to the second input terminal of the controller for transmitting a second signal thereto, the second signal being related to the temperature whereby the controller controls the test emission current by manipulating the rate of hydrogen evolution from the hydrogen source in response to the first and second signals.

10. The field emission device as claimed in claim 9, wherein the switching circuit has a second input terminal, and further comprising a voltage source operably coupled between the second input terminal of the switching circuit and a reference potential.

11. The field emission device as claimed in claim 8, further including a start-up circuit operably coupled to the cathode plate and the anode plate for powering the field emission device, and wherein said control means comprises a current source having an input terminal and an output terminal, the output terminal connected to the hydrogen source for transmitting an activation current thereto, and an N-counter circuit having an input terminal and an output terminal, the input terminal of the N-counter circuit connected to the start-up circuit for receiving a start-up signal therefrom, the output terminal of the N-counter circuit connected to the input terminal of the current source for transmitting an activation signal thereto upon receipt of the Nth start-up signal from the start-up circuit whereby receipt of the activation signal by the current source results in the transmission therefrom of the activation current, and whereby the activation current stimulates hydrogen evolution from the hydrogen source.

12. The field emission device as claimed in claim 8, wherein said control means comprises a current source having an input terminal and an output terminal, the output terminal connected to the hydrogen source for transmitting an activation current thereto, and a timer circuit having an output terminal connected to the input terminal of the current source for transmitting an activation signal at predetermined intervals whereby receipt of the activation signal by the current source results in the transmission therefrom of the activation current, and whereby the activation current stimulates hydrogen evolution from the hydrogen source.

13. A field emission device comprising:

a cathode plate;

an anode plate spaced from the cathode plate to define an interspace region therebetween;

the cathode plate and the anode plate defining a device package;

a hole defined by the device package and in communication with the interspace region; and a hydrogen-selective membrane disposed in registration with the hole.

14. The field emission device as claimed in claim 13, further including a frame disposed between the cathode plate and the anode plate, the device package further defined by the frame.

15. The field emission device as claimed in claim 13, wherein the hydrogen-selective membrane is made from a refractory metal.

16. The field emission device as claimed in claim 15, wherein the hydrogen-selective membrane is made from palladium.

17. The field emission device as claimed in claim 15, wherein the hydrogen-selective membrane is made from nickel.

18. The field emission device as claimed in claim 15, wherein the hydrogen-selective membrane is made from a palladium alloy.

19. The field emission device as claimed in claim 15, wherein the hydrogen-selective membrane is made from a nickel alloy.

20. A field emission device comprising:

a cathode plate having a plurality of electron emitters;

an anode plate spaced from the cathode plate to define an interspace region therebetween; and hydrogen gas disposed within the interspace region at a partial pressure sufficient to clean the plurality of electron emitters wherein the partial pressure of the hydrogen gas is within a range of $10^{-8}$–$10^{-5}$ Torr.

* * * * *